United States Patent [19]

Jünemann

[11] Patent Number: 4,757,774

[45] Date of Patent: Jul. 19, 1988

[54] NEEDLE GUIDE IN A SEWING MACHINE

[75] Inventor: Hubert Jünemann, Bielefeld, Fed. Rep. of Germany

[73] Assignee: Kochs Adler AG, Bielefeld, Fed. Rep. of Germany

[21] Appl. No.: 256,490

[22] Filed: Apr. 22, 1981

[30] Foreign Application Priority Data

Dec. 5, 1980 [DE] Fed. Rep. of Germany ... 8032365[U]

[51] Int. Cl.[4] ..... D05B 55/06; D05B 65/00; D05B 57/08

[52] U.S. Cl. ..... 112/181; 112/227; 112/292

[58] Field of Search ..... 112/181, 227, 228, 291, 112/292, 296, 297

[56] References Cited

U.S. PATENT DOCUMENTS

| | | | |
|---|---|---|---|
| 345,207 | 7/1886 | Bayley | 112/181 |
| 1,999,251 | 4/1935 | Moranville | 112/227 |
| 2,218,556 | 10/1940 | Rubel | 112/181 X |
| 3,053,208 | 9/1962 | Schönthaler et al. | 112/228 |
| 3,120,204 | 2/1964 | Ketterer | 112/228 |
| 3,141,432 | 7/1964 | Reeber et al. | 112/292 |
| 3,173,392 | 3/1965 | Hedegaard | 112/292 |
| 3,215,105 | 11/1965 | Kuhar | 112/228 |
| 3,658,021 | 4/1972 | Hedegaard et al. | 112/292 |
| 3,756,177 | 9/1973 | Landwehr | 112/292 X |
| 3,921,554 | 11/1975 | Vozaki et al. | 112/292 |
| 4,088,085 | 5/1978 | Hager | 112/260 X |
| 4,223,617 | 9/1980 | Upmeier et al. | 112/184 |
| 4,285,291 | 8/1981 | Ackermann et al. | 112/227 X |

FOREIGN PATENT DOCUMENTS

| | | | |
|---|---|---|---|
| 1417320 | 12/1975 | United Kingdom | 112/291 |

*Primary Examiner*—W. C. Reynolds
*Attorney, Agent, or Firm*—Max Fogiel

[57] ABSTRACT

A needle guide integrated in a thread cutter of a sewing machine installed with a hook operating about a horizontal axis and a feeding mechanism generating a relative movement as a feed motion between a workpiece and stitch former. The needle guiding element is incorporated with the thread catcher receiving member and alternately moved into operation by the thread cutter actuator. Adjustors are provided to position the needle guide with respect to the needle.

8 Claims, 2 Drawing Sheets

NEEDLE GUIDE IN A SEWING MACHINE

BACKGROUND OF THE INVENTION

The present invention relates to a needle guide in a sewing machine which is provided with a thread trimmer and a feeding device generating a relative feed movement between a workpiece and stitch forming elements.

In the German Gebrauchsmuster No. 76 05 072 U.S. Pat. No. 4,088,085 there is illustrated a sewing machine of a type in which the needle aperture is laterally moved in a timed relationship to the movement of the needle as to form a support for the downwardly moving needle thus preventing the needle from damaging the beak of the hook. In order to generate such lateral movements of the needle aperture, an expensive and complex drive mechanism is required. Due to the direction of the aperture jogging movement with respect to the angular extension of the hook shaft, this type of needle guide or support may not be easily applied with hooks having a differently arranged hook shaft as illustrated.

Generally, a sewing machine of the above-mentioned kind is equipped with a thread cutter terminating the sewing process. In order to achieve a cut of threads as close as possible at the workpiece, the thread cutter is arranged between the workpiece supporting plate and the rotary hook. Due to the constructive conditions in the known sewing machine, the described needle guide or support is arranged at a certain distance relatively to the beak of the hook. Furthermore, the described sewing machine is equipped with a feeding mechanism, which generates a continuous feeding movement in a multilateral direction. In a specific feed direction—i.e. as the workpiece is moved towards the beak of the hook—due to the action of the needle aperture a lateral deflection of the needle in a direction off the beak is rendered possible. This finally affects the loop seizing procedure, i.e. causes an unsafe stitch formation. So as to avoid interference while other feeding directions are performed, the described jogging movements of the needle aperture are shut off by means of a special control system.

A rotary hook of the aforementioned type is described in U.S. Pat. No. 3,120,204. To the rotating hook body there is screwed a needle guard formed with a surface positioning or guarding the needle. The needle guard is arranged so as to cooperate with the tip portion of the needle and thereby not avoiding a collision of the needle and the beak of the hook, while a feed movement of the workpiece in the direction towards the beak is produced. Additionally, the needle is exposed to frictional heat due to the high velocity of the needle guard contacting the needle each time at the instant of loop seizure. By the application of this type of rotary hook in a sewing machine of the aforementioned kind, the described difficulties in the form of unsafe stitch formation and damages of the needle or hook may not be eliminated.

Accordingly, it is a main object of the present invention to provide a sewing machine having a thread cutter with a needle guide or guard, which cooperates with the needle in a close position to the beak of the hook.

It is a further object of the present invention to create a needle guide, which is small in design without interfering with the thread cutter.

Another object of the present invention is to create a needle guide which is simple in construction and applicable independently of the angular arrangement of the hook shaft.

Still another object of the present invention is to create a needle guide which is economical to manufacture and easily to install in machines that are already in use in the field.

SUMMARY OF THE INVENTION

The objects of the present invention are achieved by providing the carrier of a thread cutter formed with a thread catcher additionally with a needle guide. In this manner, it is possible without the requirement of additional space and without the necessity of additional shift and control means, to either move the thread catcher or the needle guide into operating position.

By forming the needle guide as an individual part received by fastenable mounting means, an adjustment of the needle guide relative to the needle is rendered possible.

In the following the application of the needle guide according to the present invention in an automatic sewing device is described and illustrated, although the needle guide according to the present invention is applicable in standard sewing machines as well.

Other objects, advantages and features of the invention will appear from the detailed description of a preferred embodiment which will now be explained in conjunction with the accompanying drawings.

DESCRIPTION OF THE PREFERRED EMBODIMENT

Figure 1:
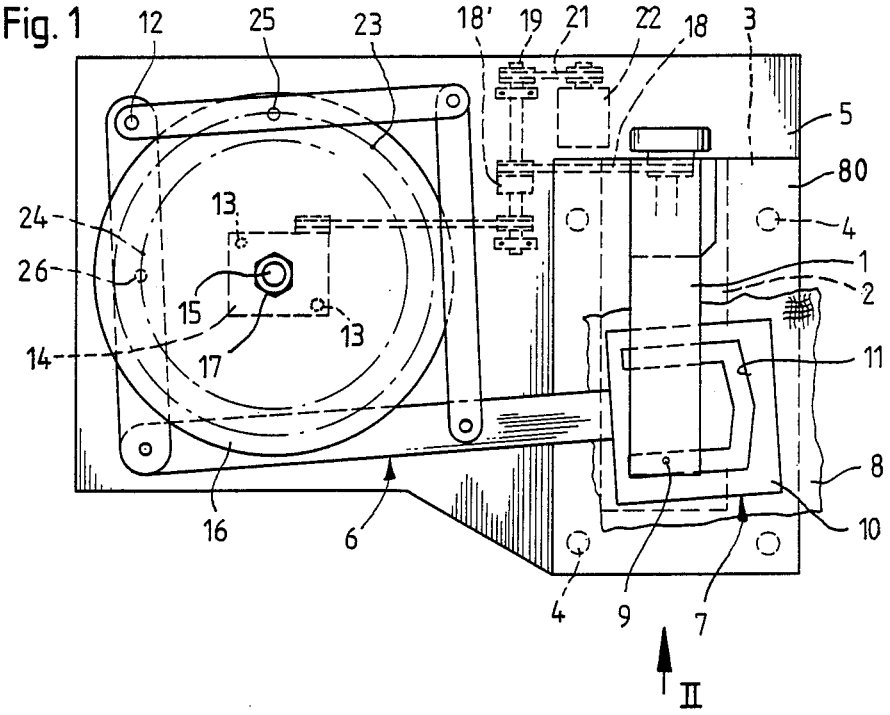
FIG. 1 is a top plan view of an automatic sewing device including a sewing machine and a workpiece guiding mechanism.

With reference to FIG. 1, there is illustrated a sewing machine 1, the base plate 2 of which is received by a plate 3 fastened by posts 4 to a stand 5. Above the base plate 2 there is displaceably supported a workpiece receiving device 7 via a linkage 6 for moving a workpiece 8 along the needle 9 of the sewing machine 1, according to a predetermined seam contour. The workpiece receiving device 7 substantially consists of a pressure plate 10 acting upon workpiece 8. Reference may be made to U.S. Pat. No. 4,223,617 for this purpose. The pressure plate 10 is formed with a slot 11 corresponding to the U-shaped seam contour and allows the passage of the needle 9. The linkage 6 is journaled at a pivot 12 located at the stand 5, which also receives a reduction gear unit 14 secured thereto by screws 13. The gear unit 14 is provided with a vertical shaft 15, to which is mounted a control disc 16 by means of a nut 17. The sewing machine 1 is drivingly connected to an intermediate shaft 19 via a belt drive 18 and a clutch 18'. The intermediate shaft 19 is rotatable in the stand 5, and is, on one hand, connected to the gear 14 via a belt drive 20, and on the other hand, it is connected via a belt drive 21 to a motor 22 arranged at the stand 5. At its front surfaces the control disc 16 is formed with grooves 23, 24 cooperating with cam followers 25, 26 of the linkage 6.

Figure 2:
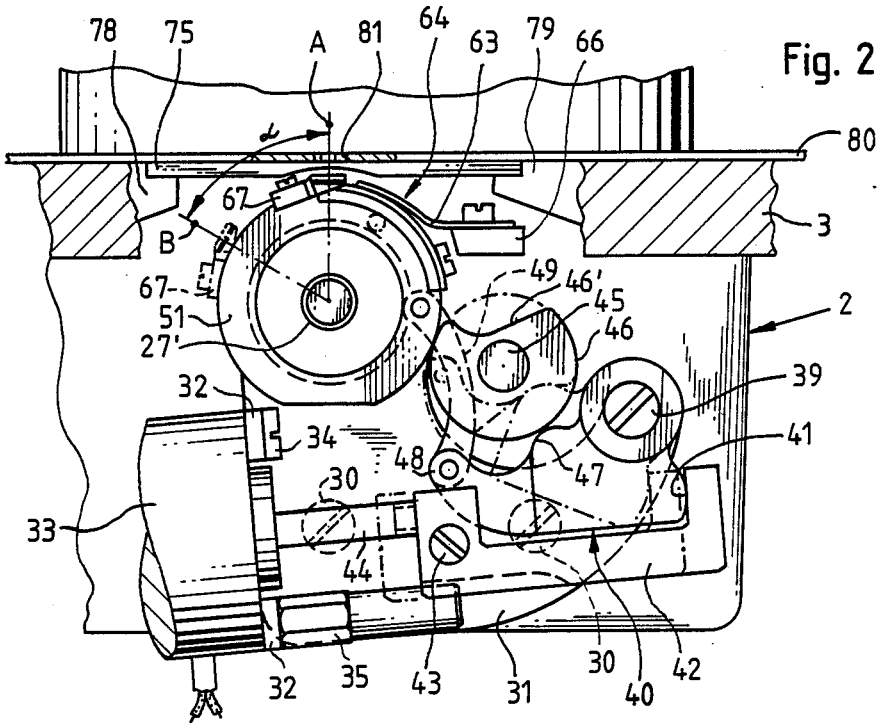
FIG. 2 shows the lower part of the sewing machine in the direction of arrow II in FIG. 1, at which the rotary hook has been removed from the hook shaft.

According to FIG. 2, the base plate 2 of the sewing machine 1 receives rotatably a shaft 27' having an axis 27, and carrying a rotary hook (loop taker) 28 (FIG. 4) secured thereto by set screws 29. The hook rotates about an axis extending perpendicular to the path of the needle. Furthermore, as may be seen from FIG. 2, there is mounted a plate 31 to the base plate 2 by screws 30, to the angular part 32 to which is fastened a solenoid 33 by means of a screw 34 and a shoulder screw 35. The plate 31 is formed with an annular part 36 extending about the shaft 27' (FIG. 5) and provided with a bearing 37 and two recesses 38. Furthermore, the plate 31 is provided with a thread (not shown) for receiving a shoulder screw 39 to which is pivoted a lever 40 (FIG. 2).

The lever 40 is formed with a cam 41, against which one end of an U-shaped drive element 42 rests. The end of the drive element 42 is secured to the actuating bar 44 of the solenoid 33 by a clamping connection having a screw 43. Furthermore, for preventing the drive element 42 from rotating about the axis of the actuating bar 44 the drive element 42 is profiled with a recess embracing a cylindrical part of the shoulder screw 35. In the base plate 2, there is held a rotatable shaft 45, the end of which, is directed to the rotary hook 28, is provided with a cam disc 46 having a cam profile 46' cooperating with a cam follower 47 of the lever 40. The lever 40 is formed with a bearing 48 for hingedly receiving one end of a tie rod 49. The other end of the tie rod 49 is pivotally connected by means of a bolt 50 (FIG. 5) to an annular carrier 51. The annular carrier 51 has a shoulder 52 with two radially extending projections 53 so as to be pivotally received and secured in bearing 37.

Figure 3:
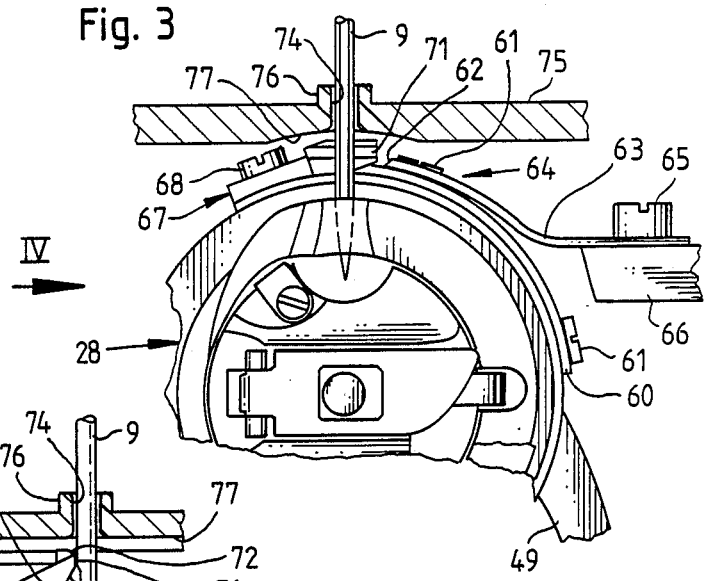
FIG. 3 is a view according to FIG. 2 showing the rotary hook arranged below the workpiece supporting plate.
Figure 5:
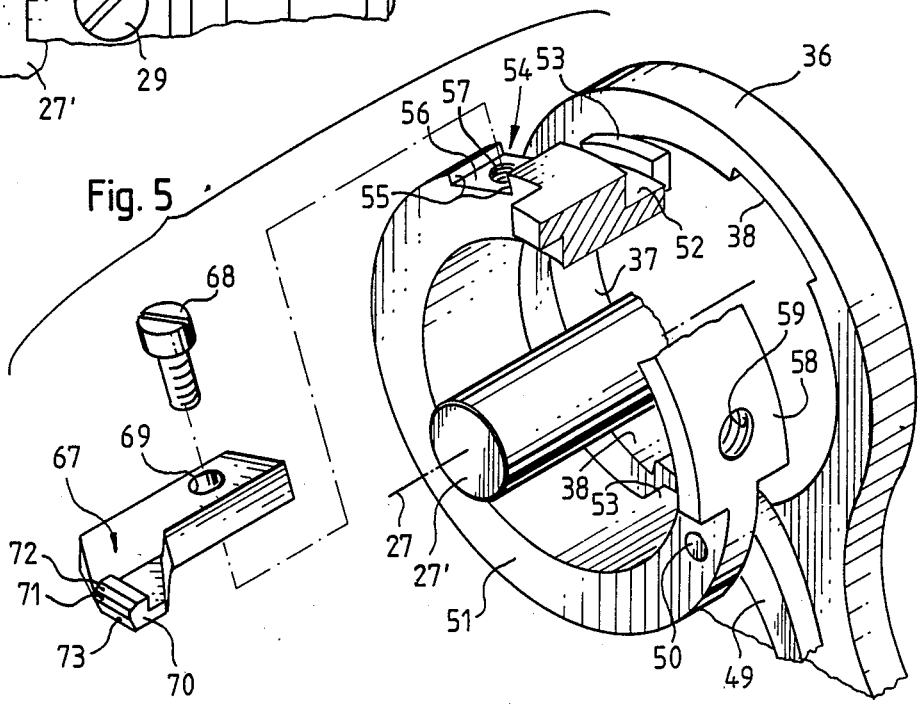
FIG. 5 is an enlarged exploded view of essential parts of the needle guide according to the present invention.

The carrier 51 is formed with a U-shaped recess 54 having two leg surfaces 55 and a screw-on surface 56 provided with a taphole 57. The carrier 51 operates about an axis arranged parallely to the hook axis 27. At the circumference of the carrier 51 there is provided a curved surface 58 formed with tapholes 59 (only one is shown in FIG. 5) for receiving a thread catcher 60 by means of screws 61 (FIG. 3). The thread catcher 60 together with the cutting edge 62 of a stationary knife 63 form essential elements of a thread cutting device 64, at which the knife 63 is fastened to a bearing 66 of the base plate 2 by means of a screw 65. the thread cutting device is well known in the art, and an example thereof is provided in U.S. Pat. No. 3,756,177. For this reason, this device is not described in further detail here.

According to FIGS. 2 to 5, a stop 67 formed with an oblong hole 69 is secured to the annular carrier 51 by means of a screw 68. As may be seen from FIG. 5, the stop 67 is provided with an angularly extending projection 70 having a surface 71 for supporting the needle 9, an upper (72) and a lower chamfer 73.

The base plate 2 is formed with bearings 78, 79 receiving a throat plate 75 fastened thereon by means of screws (not shown). The throat plate 75 is formed with a lug 76, a needle aperture 74 and a cutaway 77. According to FIG. 2, on the base plate 2 there rests a workpiece supporting plate 80 having a cutout 81 through which projects the lug 76 of the throat plate 75.

Figure 4:
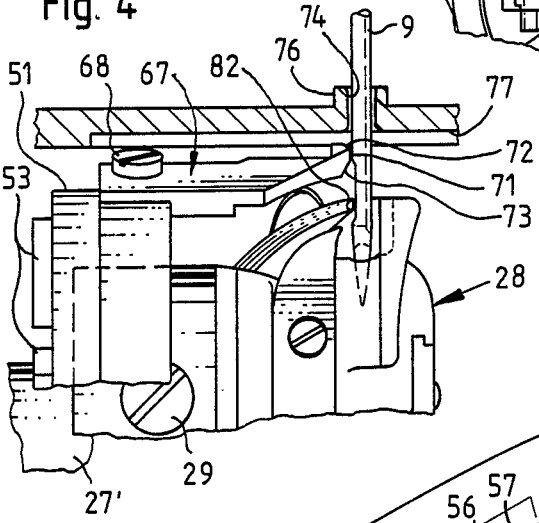
FIG. 4 is a side elevation of the rotary hook in the direction of arrow IV in FIG. 3.

The operation of the needle guide according to the present invention will be described in conjunction with FIGS. 2, 3 and 4 as follows:

While sewing, the carrier 51 together with the thread catcher 60 and the stop 67 is in the position as illustrated in FIG. 2, at which the stop 67 is located in position A. The upper chamfer 72 (FIGS. 4 and 5) provided at the stop 67 serves as a guiding surface for the needle 9 when entering the aperture 74 while the lower chamfer 73 forms a relief. The oblong hole 69 renders possible an adjustment of the stop 67 in relation to the needle 9. According to FIG. 4 illustrating the needle 9 and the rotary hook 28 in the loop seizing position, the needle 9 is supported close by to the loop seizing beak 82 of the rotary hook 28, at which the needle 9 touches the surface 71 of the stop 67 without affecting the loop seizing procedure.

At the end of a stitching process, the upper and the lower threads will be cut off between the throat plate 75 and the rotary hook 28. For this purpose the thread catcher 60 is tilted into the thread catching position. The solenoid 33 is energized by a control (not shown) at a suitable instant, so that the displacement of the lever 40, the tie rod 49 and finally the tilting of the carrier 51 by an angle $\alpha$ is effected due to the cooperating of the drive element 42 with the cam 41 and the cam follower 47 with the cam profile 46' of the cam disc 46.

In FIG. 2, the elements are illustrated in such shifted positions by dot-dash lines, at which the stop 67 is in position B. In the continuation of the thread cutting procedure, the needle 9 moves upwardly, as the threads (not shown) are pulled off and cut off by the cooperation of the cam profile 46' of the cam disc 46 with the cam follower 47 of the lever 40, and thereby tilts the stop 67 in turn into its operative or initial position A.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An arrangement in a sewing machine comprising:
stitch forming means including
a needle and
looptaker means pivoted about an axis extending perpendicular with respect to the path of said needle and formed with a loop seizing beak cooperating with said needle;
feeding means generating a relative feed movement between said needle and a workpiece; and
thread cutting means having
a movable carrier operating about an axis arranged parallel to said hook axis including a thread catching element; and a needle guide guiding said needle with respect to said loop seizing beak and positioned during operation between said workpiece and said loop-taker means, so that collision is avoided between said needle and said loop seizing beak, said needle being guided to said seizing beak independent of the position of the loop seizing beak during its motion under a plate supporting said workpiece.

2. A needle guide according to claim 1, wherein said carrier comprises:
reception means parallelly extending to said axis, and including mounting means for adjustably fastening said needle guide means to said carrier.

3. A needle guide according to claim 2, wherein said reception means comprises:

a U-shaped recess including two leg surfaces and a screw-on surface between said leg surfaces, and screw means in said mounting means for adjustably fastening said needle guide means to said carrier.

4. A needle guide according to claim 1, wherein said needle guide means comprises:

a member formed with surfaces guiding said needle.

5. An arrangement in a sewing machine comprising: stitch forming means including a needle and a hook rotating about an axis extending perpendicular to the path of said needle and formed with a loop seizing beak cooperating with said needle;

a feeding mechanism generating a relative feed movement between said needle and a workpiece, and a thread cutting device having a carrier operating about an axis arranged parallelly to said hook axis, and a thread catching element; a needle guide formed with surfaces guiding said needle with respect to said loop seizing beak and positioned during operation between said workpiece and said rotary hook, so that collision is avoided between said needle and said loop seizing beak, said needle being guided relative to said seizing beak independent of the position of the loop seizing beak during its motion under a plate supporting said workpiece.

6. A needle guide in a sewing machine according to claim 5, wherein said carrier comprises:

reception means parallelly extending to said hook axis and including mounting means for adjustably fastening said needle guide means to said carrier.

7. A needle guide according to claim 6, wherein said reception means comprises:

a U-shaped recess including two leg surfaces and a screw-on surface between said leg surfaces and screw means in said mounting means for adjustably fastening said needle guide means to said carrier.

8. An arrangement in a sewing machine comprising:

a needle and a hook rotating about an axis extending perpendicular to the path of said needle and formed with a loop seizing beak cooperating with said needle;

a feeding mechanism generating a relative feed movement between said needle and a workpiece and a thread cutting device having:

a carrier operating about an axis arranged parallelly to said hook axis, and a thread catching element;

a recess having a U-shaped profile extending parallelly to said hook axis and consisting of two leg surfaces and a screw-on surface between said leg surfaces;

a needle guide member receiving in said U-shaped recess and formed with chamfers guiding said needle with respect to said loop seizing beak and positioned during operation between said workpiece and said loop seizing beak, and screw means for adjustably fastening said needle guide member to said screw-on surface, so that collision is avoided between said needle and said loop seizing beak, said needle being guided relative to said seizing beak independent of the position of the loop seizing beak during its motion under a plate supporting said workpiece.

* * * * *